United States Patent [19]

Frushour

[11] Patent Number: 4,871,377

[45] Date of Patent: Oct. 3, 1989

[54] COMPOSITE ABRASIVE COMPACT HAVING HIGH THERMAL STABILITY AND TRANSVERSE RUPTURE STRENGTH

[76] Inventor: Robert H. Frushour, 2313 Devenshire, Ann Arbor, Mich. 48104

[21] Appl. No.: 151,942

[22] Filed: Feb. 3, 1988

Related U.S. Application Data

[63] Continuation-in-part of Ser. No. 892,186, Jul. 30, 1986, abandoned, which is a continuation of Ser. No. 690,136, Jan. 10, 1985, abandoned, which is a continuation-in-part of Ser. No. 425,289, Sep. 29, 1982, abandoned.

[51] Int. Cl.[4] ..... B24B 3/02

[52] U.S. Cl. ..... 51/309; 51/295; 51/298

[58] Field of Search ..... 51/295, 298, 309

[56] References Cited

U.S. PATENT DOCUMENTS

| | | | |
|---|---|---|---|
| 4,156,329 | 5/1979 | Daniels et al. | 51/309 |
| 4,225,322 | 9/1980 | Knemeyer | 51/309 |
| 4,268,276 | 5/1981 | Bovenkerk | 51/295 |
| 4,505,721 | 3/1985 | Almond et al. | 51/309 |
| 4,604,106 | 8/1986 | Hall et al. | 51/295 |
| 4,686,080 | 8/1987 | Hara et al. | 51/309 |
| 4,705,123 | 11/1987 | Dennis | 51/309 |

*Primary Examiner*—Paul Lieberman
*Assistant Examiner*—Willie J. Thompson
*Attorney, Agent, or Firm*—Robert B. Crouch

[57] ABSTRACT

A composite compact adapted for high-temperature uses, such as a cutter on a rotary drill bit, which includes a relatively thick table of diamond or boron nitride particles with a strong, chemically inert binder matrix and a thin metal layer bonded directly to the table in a HP/HT press. The table is characterized by having high thermal stability at temperatures up to 1200° C. The thickness of the thin metal layer, which does not exceed one-half that of the table, is selected such that at temperatures up to 1200° C. the differential forces due to thermal expansion do not exceed the fracture strength of the table.

13 Claims, 1 Drawing Sheet

COMPOSITE ABRASIVE COMPACT HAVING HIGH THERMAL STABILITY AND TRANSVERSE RUPTURE STRENGTH

CROSS REFERENCE TO RELATED APPLICATIONS

This application is a continuation-in-part of U.S. patent application Ser. No. 892,186, filed July 30, 1986, abandoned which is a continuation of U.S. patent application Ser. No. 690,136, filed Jan. 10, 1985, abandoned which is in turn a continuation-in-part of U.S. patent application Ser. No. 425,289, filed Sept. 29, 1982, abandoned and assigned to the assignee of the invention herein, is directed to a process of manufacturing a composite abrasive compact having high thermal stability which includes the steps of: sintering a mass of abrasive particles in a high pressure, high temperature (HP/HT) press in the presence of a solvent-catalyst sintering aid, such as cobalt; removing the solvent-catalyst from the resultant compact by leaching; re-sintering the compact in the HP/HT press in the presence of a non-catalyst sintering aid to create a tough bonding matrix; and bonding the compact to a metallic substrate in the HP/HT press.

BACKGROUND OF THE INVENTION

It is well known to sinter a mass of polycrystalline particles, such as diamond or boron nitride, in the presence of a suitable solvent-catalyst by means of a HP/HT press to form a compact with good particle-to-particle bonding. Apparatus and techniques for forming such compacts are disclosed in U.S. Pat. Nos. 2,941,248-Hall, 3,141,746-DeLai, 3,743,489 and 3,767,371. While such compacts have good abrading and cutting characteristics, they have low transvers rupture strength and are not readily adapted to cutting operations due to the difficulty in securing them to a tool holder.

In order to mechanically strengthen the polycrystalline compacts and provide a convenient means of bonding or clamping to a tool holder to form a cutting tool, it has been proposed to bond the compact to a thick substrate of cemented carbide. U.S. Pat. No. 3,745,623-Wentorf et al teaches sintering of the particle mass in conjunction with tungsten carbide to produce a composite compact in which the particles are bonded directly to each other and to a cemented carbide substrate. Such composite compacts have been widely used in the cutting and drilling arts, since the cemented carbide substrate can be clamped or bonded to a suitable tool holder to provide a cutting edge for a cutting or drilling tool.

The composite compacts produced by the prior art techniques generally have utilized a solvent-catalyst sintering aid, such as cobalt, to accomplish particle-to-particle bonding in the HP/HT press. Such compacts have been limited to low-temperature applications, because, as recognized in U.S. Pat. No. 4,288,248-Bovenkerk et al, they degrade at temperatures above approximately 700° C. The thermal degradation derives from the use of catalytic metals, such as cobalt or aluminum as the sintering aid for bonding the diamond or boron nitride crystals and results in accelerated wear or catastrophic failure of such compacts when employed in high-temperature applications, such as drilling rock formations having compressive strengths above 20,000 psi.

Difficulty has been experienced in utilizing the composite compacts produced by the prior art techniqes for drilling rock formations with even intermediate compressive strengths, i.e., 10,000 to 20,000 psi. In such applications it is generally necessary to braze the compact to a metal-bonded carbide pin which is received in a drill crown. Since the strength of the braze bond or joint is directly related to the liquidus of the braze filler metal employed, it is desireable to use the highest liquidus filler metals possible. However, because of the thermal degradation potential, it has been necessary to use braze filler metals with a liquidus below 700° C. Even then temperatures approaching those at which the crystalline layer is degraded are required.

To avoid this problem, U.S. Pat. No. 4,225,322-Knemeyer has proposed a process for brazing a composite compact, such as made by the prior art techniques, to a pin or stud with a high liquidus braze filler metal by applying heat to the pin, to the filler metal and to the compact substrate while cooling the crystalline diamond or boron nitride table with a heat sink. This process allows production of cutting elements for rotary drill bits which utilize the capabilities of the crystalline composite compacts within the limits created by the construction of the compacts and the differential heating of the various components of the cutting elements. The use of cobalt as the solvent-catalyst in the prior art composite compacts imposes a limit on the operating temperatures due to thermal degradation. In addition, the thick cemented carbide substrate, which is approximately six times the thickness of the polycrystalline table, creates a very significant moment arm through which the working forces applied to the crystalline table are transmitted to the braze joint, thus substantially multiplying the effect of such forces on the joint. Furthermore, internal stresses are created within the composite compact due to the differential heating of the substrate and crystalline table. Also, the material of the pin is stressed by the high temperatures employed in the brazing process.

SUMMARY OF THE INVENTION

It is an object of the invention to provide a polycrystalline diamond or boron nitride composite compact which is thermally stable up to 850° C. and preferably to 1200° C.

It is another object to provide a composite compact which has a transverse rupture strength of at least 70 $Kg/mm^2$ and preberably 100 $Kg/mm^2$.

It is a further object to provide a composite compact which has a minimum profile of 10 to 50 mils and which is adapted for ready bonding to a wide range of support structures without stress to the compact or structures.

These and other objects of the invention are realized by a composite compact having a well consolidated polycrystalline diamond or boron nitride abrasive table, with a binding matrix of silicon or boron or alloys/mixtures thereof with nickel, iron, cobalt or other Group VIII metals dispersed throughout, and a thin layer of metal which has a melting point of 1000° C. or higher bonded directly to the polycrystalline table in a HP/HT press, the layer of metal being up to approximately one-half the thickness of the table.

DRAWING

The best mode presently contemplated of carrying out the invention will be understood from the detailed description of the preferred embodiment illustrated in the accompanying drawing in which.

DETAILED DESCRIPTION

In down-hole drilling operations, such as employed in oil and gas field explorations where a rotary drill bit is carried at the end of a drill string which may be up to a mile in length, there are a variety of forces which act on the cutters of the drill bit. The predominate forces can be categorized broadly as (1) shear forces generated by the cutting action of the cutters and which act generally parallel to the exposed face of each cutter, (2) impact forces caused by vertical or lateral movement of the drill bit within the hole and which act transversly of the cutter, and (3) thermal forces caused by the different rock formations encountered which elevate the operating temperature of the cutter and which act on the abrasive table of the cutter.

Figure 1:
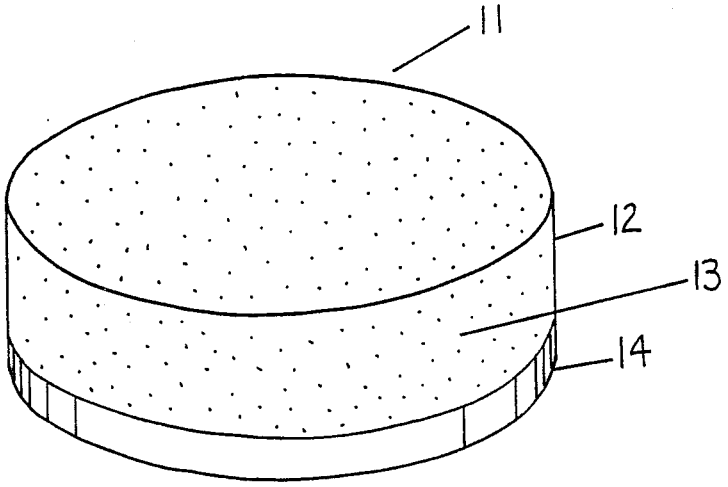
FIG. 1 is a perspective view at an enlarged scale of the composite compact of the present invention.

Referring to FIG. 1 of the drawing, a composite compact 11 is shown as including an abrasive table 12 of well sintered polycrystalline diamond or boron nitride. The crystals are bonded in particle-to-particle contact with interstices between the particles. A strong, tough binder matrix 13 of silicon or boron or alloys/mixtures thereof with nickel, iron, cobalt or other Group VIII metals, is infiltrated into the interstices throughout the table. A thin layer of metal 14 is bonded directly to the table in a HP/HT press. The thickness of the metal layer is selected such that at temperatures of 850° C. to 1200° C. the differential forces due to thermal expansion do not exceed the fracture strength of the table. This will be influenced by the composition of the metal layer, but a layer of tungsten carbide approximately 5 mil thick is satisfactory. The metal, which must provide a smooth surface suitable for brazing, is selected from the group of tungsten carbide, tungsten, tantalum, titanium and/or Group VIII metals. The use of non-catalyst solvents, such as silicon, boron and their alloys/mixtures, as the binder matrix or second phase produces an abrasive compact which is thermally stable at temperatures up to 850° C. and preferably 1200° C. This permits the attachment of the composite compact to a tool holder with high strength braze joints without the risk of thermal degradation of the table or the holder.

Figure 3:
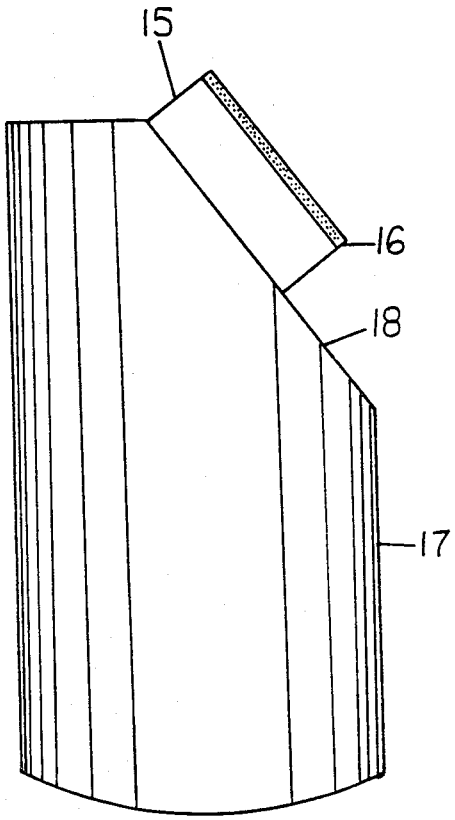
FIG. 3 PRIOR ART
FIG. 3 is an elevation view similar to FIG. 2 of a prior art composite compact bonded to a stud for use with a rotary drill bit.
Figure 2:
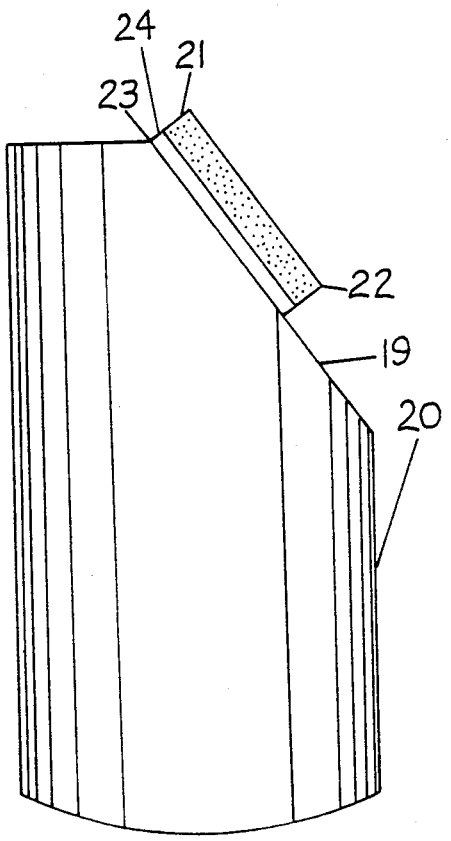
FIG. 2 is an elevation view of the composite compact of FIG. 1 bonded to a stud for use with a rotary drill bit.

The dimensions and shape of the present composite compact may be varied widely and are largely dependent upon the needs of a particular application or use for which the compact is intended. However, in drilling applications the profile of the present composite compact is lower by at least half when compared with the conventional prior art composite compacts. This derives from the fact that, as illustrated in FIG. 3, the substrate 15 in the conventional prior art composite compact is typically up to six times thicker than the abrasive table 16. The purpose of this construction is to provide mechanical support for the table and to shield the thermally-sensitive table from the elevated temperatures generated by soldering or brazing of the substrate to a tool holder (stud) 17. This shielding is accomplished by physically spacing the table from the attachment surface 18 by the interposition of a substantial heat sink therebetween. By way of contrast, since the table of the present composite compact is thermally stable at temperatures in excess of those encountered in soldering or high strength brazing, it is not necessary to shield the table from the effects thereof. This is illustrated in FIG. 2 wherein a composite compact 21 is brazed to the attachment surface 19 of a tool holder (stud) 20. The structure depicted in FIG. 2 provides for a substantial reduction in the magnitude of the forces applied to the braze joint 23 between the thin metal layer 24 and the attachment surface 19 in comparison with the prior art structure of FIG. 3. Shear forces generated at the exposed face of the table 22 are transmitted to the braze joint 23 through a moment arm which is equal in length to the height of the composite compact, i.e., combined thickness of the table 22 and the thin metal layer 24. Since the maximum height of the present composite compact is projected to be 50 mils (25 mils nominal), as compared with 139 mils for the prior art, this results in a minimum reduction of approximately 65% in the length of the moment arm. Accordingly, the forces transmitted to the braze joint with the present composite compact are only 35%, or less, of those experienced by the prior art device.

The present composite compact has been described in connection with its use as a cutter on a rotary drill bit since the conditions of wear, loading, thermal variations, environment, etc., represent worst case operating conditions. However, the present composite compact is readily useable in any high temperature cutting or wear application where it is desireable or necessary to braze, or otherwise bond, the compact to a tool holder. All references cited are expressly incorporated herein by reference.

The present composite compact is prepared by sintering a mass of abrasive particles in a refractory metal cylinder. Diamond particles of approximately 1 to 1000 microns in diameter are blended together and placed in the cylinder in contact with a layer of solvent-catalyst sintering aid of the Group VIII metals or alloys thereof. The cylinder is subjected to high pressure, 50 to 65 Kbar, and high temperature, 1200° to 1600° C., in a HP/HT press for a period of 1 to 10 minutes. When the diamond mass is well sintered the compact is removed from the press and placed in a suitable aqua-regia bath for approximately 7 days to dissolve the metallic second phase. The compact then consists essentially of diamond particles bonded together with a network of interconnected interstices extending throughout the compact. While aqua-regia is preferred, the metallic second phase can be removed by other acid treatment, liquid zinc extraction, electrolytic depletion or similar processes.

The sintered compact is then placed in a second refractory metal cylinder along with a layer of non-catalyst sintering aid, such as silicon or boron or alloys/mixtures thereof with nickel, iron, cobalt or other Group VIII metals, and a thin layer of tungsten carbide or similar metal. The cylinder is then placed in the HP/HT press and the diamond re-sintered and bonded to the thin layer. In this step, the sintering aid material infiltrates into the interstices in the compact and assists in the further sintering of the diamond. The pressure, temperature and time employed in the re-sintering step are similar to those employed in the initial sintering. The resultant bonding matrix is very hard, tough and is chemically inert so it will not catalyze the back-conversion of diamond to graphite. Furthermore, since the bonding matrix is intact, the transverse rupture strength of the compact is enhanced. Since the non-catalyst sintering aid material melts at temperatures (1050° to 1200° C.) which are below the melting point of cobalt (1350° C.) at the pressures employed, it infiltrates into the interstices before cobalt is released from the tungsten carbide layer. Any mixing of the cobalt with the alloyed or carbide forms of the sintering aid seems to occur primarily at the interface between the diamond and the thin metal layer and in the interstices immediately above the interface. Furthermore, there is no chemical reaction which might inhibit bonding between the compact and metal layer. What mixing does occurs is confined primarily to the interstices adjacent the interface and results information of alloys of cobalt with sintering aid material which are non-catalytic in their effect.

The following example shows how the present invention can be practiced, but should not be construed as limiting. A mass of diamond crystals size 120/140 U.S. mesh was sintered in a HP/HT press at 55 Kbar and 1500° C. for 10 minutes with cobalt as the sintering aid until it was well sintered. The sample was then removed from the press and placed in hot aqua-regia for sixty hours to remove the cobalt. The sintered compact was then placed in the HP/HT press in contact with a 75/25 wt. % ratio mixture of elemental silicon and nickel powder and a sintered tungsten carbide disc. After processing at 55 Kbar and 1500° C. for two minutes the composite compact was ground and lapped on both sides to a thickness of 35 mils. The finished composite compact consisted of a 30 mil table of polycrystalline diamond with substantial particle-to-particle bonding and interstices filled with silicon, nickel, their alloys and compounds (such as SiC), having directly bonded thereto a 5 mil layer of tungsten carbide. A tungsten carbide support disc 125 mils thick was then brazed to the layer with the process described in co-pending U.S. patent application Ser. No. 153,466, filed 5/9/89, using a commercial high-strength braze material identified as Cocuman.

Several specimens of commercially available prior art cobalt-infiltrated composite compacts produced in accordance with the teachings of U.S. Pat. No. 3,745,623-Wentorf et al were acquired for comparison testing. The tungsten carbide substrate of one such specimen was ground and lapped to a thickness of approximately 5 mils and then brazed to a 125 mil tungsten carbide support disc using the same process referred to above. This specimen showed extensive thermal damage when tested for abrasion resistance and when visually examined under a microscope.

After brazing, the sample of the present invention was tested for abrasion resistance, impact strength and shear strength of the bond between the diamond table and the support disc.

The sample of the present invention was checked for abrasion resistance by dressing a silicon carbide wheel. The abrasion resistance was in all respects similar to commercial prior art unbrazed composite compacts. The sample was examined by microscope and no thermal damage was detected.

The sample of the present invention and a specimen of the commercial prior art composite compact were tested for impact strength by subjecting them to repeated mechanical loading to the diamond face of each. Results of this test showed that the fracture toughness of the brazed sample of the present invention was at least ten times greater than that of the commercial prior art composite compact.

The bonding strength of the diamond compact layer brazed to the tungsten carbide support disc was tested by placing the sample of the present invention in a fixture to securely hold the support disc and a hardened steel plate was forced against the diamond table via pressure exerted from a hydraulic cylinder. Results showed that the force necessary to shear off the diamond table was comparable to that required for shearing the diamond table from a commercial prior art composite compact.

While the invention has been described with reference to specifically illustrated preferred embodiments, it should be realized that various changes may be made without departing from the disclosed inventive subject matter particularly pointed out and claimed herebelow.

I claim:

1. A composite abrasive compact having high thermal stability at temperatures of at least 850° C. and transverse rupture strength of at least 70 $Kg/mm^2$ which includes a relatively thick table of well sintered abrasive particles bonded in particle-to-particle contact with interstices between adjacent particles, a strong chemically inert binder matrix dispersed throughout the table in the interstices, and a relatively thin layer of metal having a melting point above 1000° C. bonded directly to the table in a HP/HT press.

2. A composite abrasive compact as set forth in claim 1 wherein the table is at least twice the thickness of the layer of metal.

3. A composite abrasive compact as set forth in claim 2 wherein the table is at least 10 mils thick and the layer of metal is no more than 5 mils thick.

4. A composite abrasive compact as set forth in claim 1 wherein the abrasive particles are diamond and the binder matrix is chosen from the group including silicon, boron, alloys/mixtures thereof with nickel, iron, or other Group VIII metals.

5. A composite abrasive compact as set forth in claim 4 wherein the thin layer of metal is chosen from the group including tungsten, tungsten carbide, tantalum, titanium and Group VIII metals.

6. A composite compact which is thermally stable at temperatures up to 1200° C. and which includes an abrasive table of well sintered particles chosen from the group which includes diamond and boron nitride, said particles being bonded in particle-to-particle contact, a strong binder matrix which includes a non-catalyst solvent metal dispersed throughout the table, and a thin layer of metal having a melting point above 1000° C. bonded directly to the table in a HP/HT press.

7. A composite compact as set forth in claim 6 wherein the thickness of the thin layer of metal is such that at temperatures up to 1200° C. the differential forces due to thermal expansion do not exceed the fracture strength of the table.

8. A composite compact as set forth in claim 7 wherein the thickness of the thin layer of metal does not exceed one-half that of the table.

9. A composite compact as set forth in claim 7 wherein the binder matrix is chosen from the group including silicon, boron, alloys/mixtures of silicon or boron with nickel, iron, cobalt or other Group VIII metals.

10. A composite compact as set forth in claim 9 wherein the thin layer of metal is chosen from the group including tungsten, tungsten carbide, tantalum, titanium and Group VIII metals.

11. A composite compact which is thermally stable at temperatures up to 1200° C. and which includes an abrasive table of well sintered particles chosen from the group which includes diamond and boron nitride, said particles being bonded in particle-to-particle contact, and a thin layer of metal having a melting point above 1200° C. bonded directly to the table in a HP/HT press, the thickness of the layer being such that at temperatures up to 1200° C. the differential forces due to thermal expansion do not exceed the fracture strength of the table.

12. A composite compact as set forth in claim 11 wherein the thickness of the thin layer of metal does not exceed one-half that of the table.

13. A composite compact as set forth in claim 12 wherein the thin layer of metal is chosen from the group including tungsten, tungsten carbide, tantalum, titanium and Group VIII metals.

* * * * *